United States Patent [19]

Wetherell et al.

[11] Patent Number: 4,917,647

[45] Date of Patent: Apr. 17, 1990

[54] COMB AND TALK DOLL

[76] Inventors: Joseph J. Wetherell, 20 Woodsbridge Rd., Katonah, N.Y. 10536; Larry Reiner, 1 Horizon Rd., Fort Lee, N.J. 07024

[21] Appl. No.: 315,594

[22] Filed: Feb. 27, 1989

[51] Int. Cl.[4] ..... A63H 3/44

[52] U.S. Cl. ..... 446/297; 446/372; 446/268

[58] Field of Search ..... 446/268, 295, 296, 297, 446/298, 299, 300, 302, 319, 372, 391, 397, 301, 304, 305, 489

[56] References Cited

U.S. PATENT DOCUMENTS

| | | | |
|---|---|---|---|
| 1,920,027 | 7/1933 | Wilhelm | 446/319 X |
| 3,229,421 | 1/1966 | Ostrander | 446/304 |
| 3,287,020 | 11/1966 | Beebe | 446/302 X |
| 3,298,130 | 1/1967 | Ryan | 446/299 |
| 3,514,899 | 6/1970 | Bonanno et al. | 446/298 |
| 3,698,134 | 10/1972 | Amici et al. | 446/319 |
| 4,074,460 | 2/1978 | Thorn et al. | 446/304 |
| 4,231,184 | 11/1980 | Corris et al. | 446/301 X |
| 4,675,519 | 6/1987 | Price | 446/297 X |
| 4,801,286 | 1/1989 | Orenstein et al. | 446/319 |

*Primary Examiner*—Robert A. Hafer
*Assistant Examiner*—Sam Rimell
*Attorney, Agent, or Firm*—Natter & Natter

[57] ABSTRACT

A comb and talk doll includes a hair actuated sound generating mechanism. A hair cluster is resiliently secured within a doll head to one end of a spring urged hair shaft. Comb and/or brush engagement of the hair cluster exteriorly of the doll head, linearly displaces the hair shaft. Another end of the hair shaft cooperatively interacts with a cam surface of a pivotal arm for actuating the sound mechanism. In another embodiment, a wire link provides an interconnection between the hair cluster and a pivotal arm. When the hair cluster is released, a spring force restores the pivotal arm to its initial position to deactuate the sound mechanism. In an alternate embodiment, displacement of the hair shaft during combable engagement of the hair cluster, closes an electrical circuit for energizing the sound mechanism.

17 Claims, 2 Drawing Sheets

FIG. 1
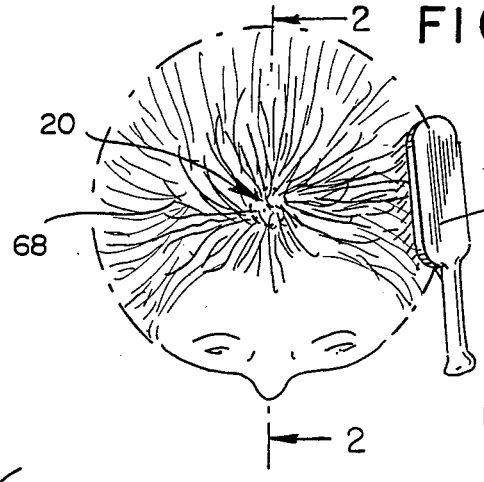
FIG. 3
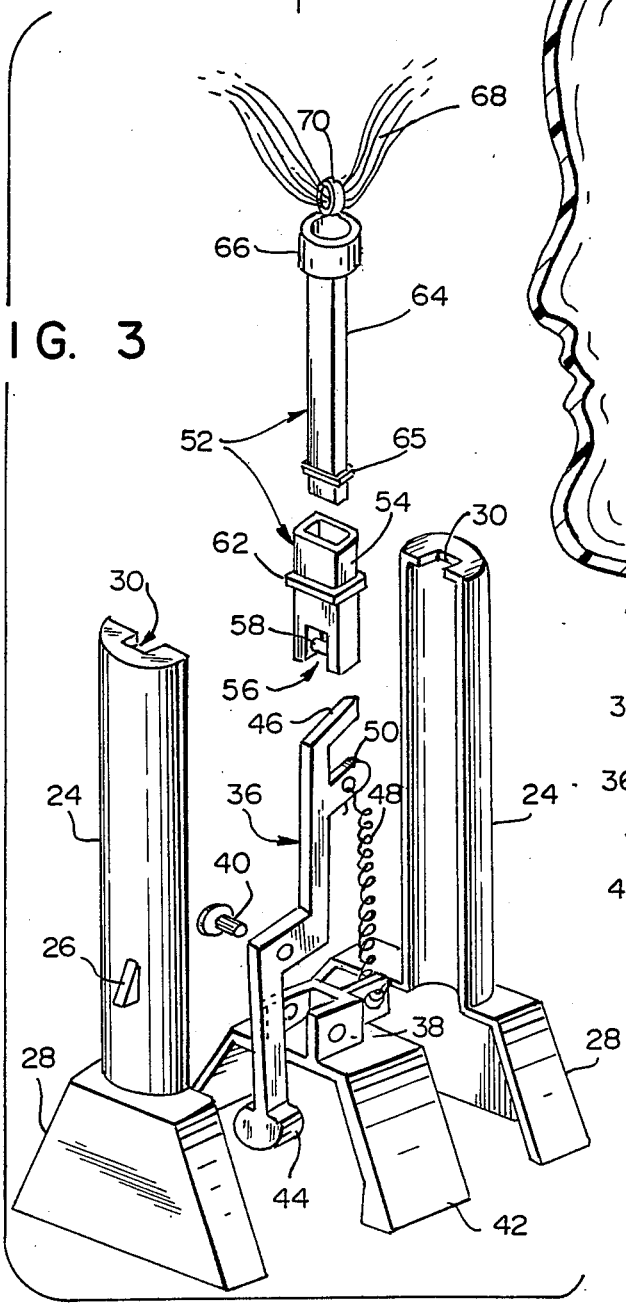
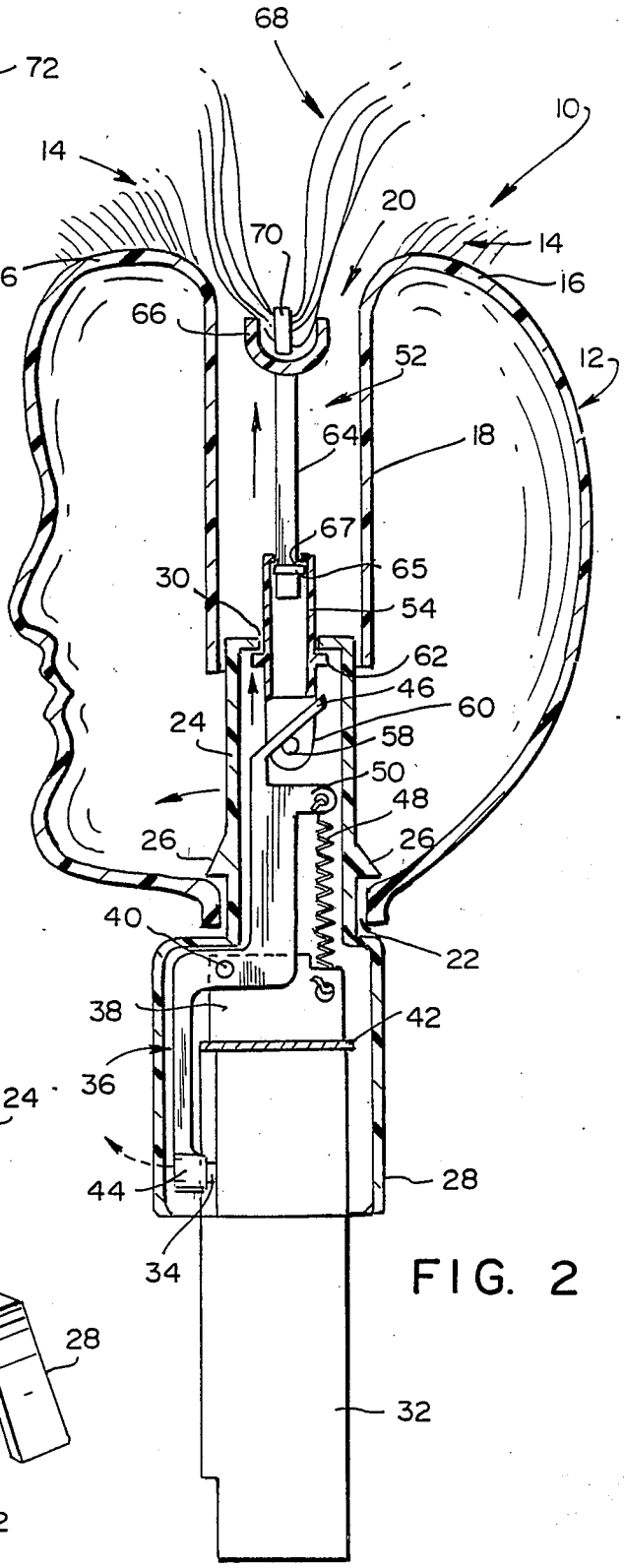
FIG. 2

COMB AND TALK DOLL

FIELD OF THE INVENTION

This invention relates generally to amusement devices and especially to a noise generating figure toy.

In particular, the device of this invention concerns a doll having a hair actuated voice mechanism.

BACKGROUND ART

Sound producing dolls and animals have been well-known as applied to childrens' playthings and provide an added dimension of realism. Many of these toys included voice mechanisms that were actuated by doll movement and/or gravity. Typical of such devices were the dolls shown in U.S. Pats. Nos. 3,303,605 and 3,413,756. Another doll was designed to emit sounds in response to optical sensing, as shown in U.S. Pat. No. 4,675,519. Still other playthings reacted to a pull-string or mechanical windup spring for producing audible sounds.

The sound actuation of the previously mentioned dolls however, was not initiated by an interaction with the dolls' hair. Although U.S. Pat. No. 1,264,341 discusses noise generation by withdrawal of a tape from within the mouth of a figure head; that patented device was not concerned with hair actuation.

Furthermore, the sound actuation of the aforementioned toy devices were not directly related to corresponding learning processes or combined with a teaching concept such as improving the manipulative skills required for hair brushing and combing.

BRIEF DESCRIPTION OF THE INVENTION

Briefly, the nature of this invention involves a "talking" doll having a head with yieldably extensible strands of hair or in an alternative form, a plush animal having a similar coat of extensible hair or mane. When the hair is combed or brushed, hair strands are frictionally engaged and a tensile force is produced for actuating a sound generating mechanism.

The hair strands are secured in a cluster resiliently fastened within an aperture in the head of the doll with the hair strands radiating from the aperture. The hair cluster is attached to a spring-urged hair shaft adapted for linear movement. When the hair is extended, as upon combing, the hair shaft coacts with a cam surface to displace a pivotal arm which, in turn, actuates a sound generating mechanism for producing recorded or synthesized voice messages or other sound effects. The voice messages can be related to hair combing and/or hair grooming functions.

In an alternate embodiment, the hair shaft includes a wire link which interconnects the hair cluster with the pivotal arm. A further embodiment utilizes a spring-urged piston for providing an electrical switch for actuating the sound mechanism.

A feature therefore, of this invention is that it is adapted to provide a learning experience for the child.

Still another aspect of this invention is that the components can be readily assembled.

Another advantage of this invention is that it is adapted for use with conventional sound mechanisms.

In view of the foregoing, it should be apparent that the present invention overcomes many of the shortcomings and deficiencies of the prior art and provides an improved comb and talk doll.

Having thus summarized the invention, it will be seen that it is an object thereof to provide a comb and talk doll of the general character described herein which is not subject to the aforementioned shortcomings.

Another object of this invention is to provide a comb and talk doll having combable and/or brushable hair.

A further object of this invention is to provide a comb and talk doll wherein a combing or brushing action of the hair actuates a sound mechanism within the doll.

Still another object of this invention is to provide a comb and talk doll wherein the sound mechanism can be preprogrammed to generate voice messages related to hair care and grooming.

Yet another object of this invention is to provide a comb and talk doll which is compatible for use with conventional sound mechanisms.

A still further object of this invention is to provide a comb and talk doll that is simple in construction, reliable in use, and well adapted for mass production fabrication techniques.

Other objects of this invention will in part be apparent and in part will be pointed out hereinafter.

With these ends in view, the invention finds embodiment in certain combinations of elements and arrangements of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention:

FIG. 1 is an overhead plan view of a comb and talk doll in accordance with this invention showing a head of hair and a brush being applied thereto;

FIG. 2 is an elevational view, to an enlarged scale, taken along line 2—2 of FIG. 1, showing a plurality of combable hair strands secured within the head and further showing a spring urged pivotal actuator arm for interaction with a sound mechanism;

FIG. 3 is an exploded perspective view showing the apparatus of FIG. 1;

DETAILED DESCRIPTION OF THE INVENTION

Figure 5:
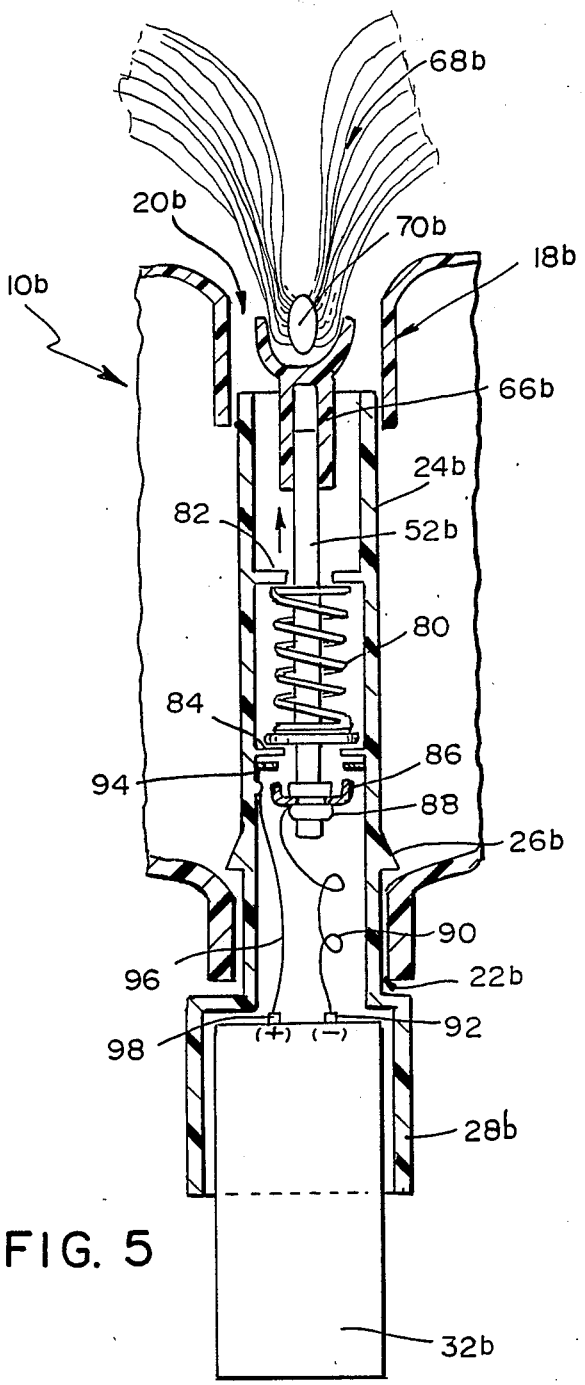
FIG. 5 is a sectional view of another embodiment of the comb and talk doll showing a plurality of hair strands secured to a spring urged shaft which actuates a sound mechanism.

Referring now in detail to the drawings, the reference numeral 10 denotes generally a comb and talk toy doll as encompassed by this invention.

The exemplary embodiment as shown in FIGS. 1–3, includes a doll head 12; a doll torso adapted for attachment to the head 12, has not been shown add can be of any conventional design. Although this invention will be described with reference to children's dolls, the device could be applied to toy animals wherein, for example, a barking sound can be generated in response to brushing the coat of hair.

The head 12 is preferably formed of a polyvinyl or similar thermoplastic material which can be rotationally molded to form the doll head 12 that includes a plurality of hair strands 14 which are rooted within a scalp area 16.

A tubular internal passageway 18 extends downwardly along a substantially vertical axis through the head 12 from a central aperture 20 within the scalp area 16. The head 12 also includes a neck opening 22 in alignment with the central aperture 20. The doll torso is adapted for attachment to the head 12 around the neck opening 22 as is known in the art.

The periphery of the central aperture 20 includes a smooth surface curvature from the scalp area 16 and merging with the tubular passageway 18 as best shown in FIG. 2.

A neck tube 24 is insertable within the neck opening 22 and is slidably accommodated within the tubular passageway 18 as shown in FIG. 2. A pair of headlocks 26 angularly project from the neck tube 24, for retaining the neck tube 24 within the head 12. It should be understood that the neck opening 22 is yieldably expandable for accommodating the headlocks 26 as the neck tube 24 is inserted upwardly through the neck opening 22.

A lower portion of the neck tube 24 includes a flared housing 28 which is substantially trapezoidal in shape. An upper portion of the neck tube 22 is provided with a slotted opening 30 which will be further described hereinafter. The neck tube 24 and the housing 28 are preferably integrally molded in complementary interfitting longitudinal half-sections (see FIG. 3) to facilitate assembly.

A sound device 32, such as a battery powered voice mechanism as manufactured by Ozen Sound Devices, Inc. (Model No. DPG55SC) is utilized for providing prerecorded voice messages. It should be noted that other types of sound generating devices including electronic voice synthesizers having a preprogrammed voice chip or equivalent audio mechanisms can also be utilized. The sound device 32 is activated by depressing a spring-loaded pushbutton 34.

In accordance with this invention, the pushbutton 34 is depressed by an actuator arm 36 which is pivotally mounted to a rivet 40 on a bracket 38. The bracket 38, in turn, is attached to a frame 42 conforming in shape and adapted for accommodation within the housing 28. The frame 42 further secures the sound device 32 for positioning the pushbutton 34 in registration with a pad 44 located at one end of the actuator arm 36. An opposite end of the actuator arm 36 includes an inclined finger 46. A spring member 48 is fastened at one end to the bracket 38 and at its other end to a tab 50 extending from the actuator arm 36. The spring member 48 urges the pad 44 in a direction away from the pushbutton 34 to an initial position, as indicated by the broken line arrow in FIG. 2.

A hair shaft 52 is positioned within the tubular passageway 18 for interaction with the actuator arm 36. A lower section 54 of the hair shaft 52 includes a channel 56 having a transverse pin 58 spanning the channel 56. The channel 56 is adapted for receiving the inclined finger member 46 with the transverse pin 58 engaging a cam surface 60 of the inclined finger member 46. It should be further noted that the lower section 54 includes a rib 62 which cannot pass through the slotted opening 30 thus securing the lower section 54 within the neck tube 24 and limiting upward displacement of the hair shaft 52.

An upper section 64 of the hair shaft 52 is connected at one end to the lower section 54 as for example, by a snap fit engagement or similar interlocking arrangement. In this embodiment a flexible gasket 65 and an internal groove 67 provide the interconnection.

An opposite end of the upper section 64 includes a hair cup 66. The hair cup 66 is adapted for receiving a plurality of simulated hair strands comprising a hair cluster 68, centrally secured by a rigid hair band 70. The band 70 is adapted for accommodation within the hair cup 66 and can be attached therein by an adhesive cement or similar fastener.

The hair cluster 68 is of sufficient length to extend over the rooted hair strands 14 for combable and/or brushable engagement.

The neck tube 24 and the housing 28 components are readily assembled by initially attaching the actuator arm 36 to the frame 42 and then by securing the spring member 48 between the tab 50 and the bracket 38. The lower section 54 of the hair shaft 52 is inserted within the neck tube 24 and the respective half-sections of the neck tube 24 are secured together with the frame 42 accommodated within the housing 28. The sound device 32 is next secured to the frame 42 and the neck tube 24 is inserted through the neck opening 22. The hair cluster 68 is secured within the hair cup 66 and the upper section 64 of the hair shaft is then urged into snap fit engagement with the lower section 54. It should thus be seen that the construction facilitates the assembly process.

In operation, when the hair cluster 68 is engaged by a comb or brush 72, the hair shaft 52 is urged upwardly. It should be noted that a curvature around the periphery of the central aperture 20 provides a low friction surface so that the hair cluster 68 does not adhere to or bind on any sharp edges. As the hair shaft 52 is displaced, the transverse pin 58 acting on the cam surface 60 of the inclined finger member 46 will urge the actuator arm 36 about the rivet 40 in a counterclockwise direction as shown by the solid line arrows. The angular displacement of the arm 36 urges the pad 44 into contact with the pushbutton 34 for actuating the sound mechanism 32. A series of prerecorded voice messages can be broadcast each time the pushbutton 34 is actuated. These messages can convey information related to corresponding hair combing or hair dressing functions.

When the comb or brush is removed, the spring member 48 will return the actuator arm 36 to its initial position and the pushbutton 34 will be released. The hair cluster 68 will also be retracted into the aperture 20, by the spring force to its preextended position.

It should be noted that the lower section 54 of the hair shaft 52 has a loose fit through the slot opening 30 so as to allow free movement of the hair shaft 52 in all directions as the hair cluster 68 is being manipulated. Furthermore, the hair shaft 52 can be formed as a unitary member by combining the lower section 54 and the upper section 64.

Figure 4:
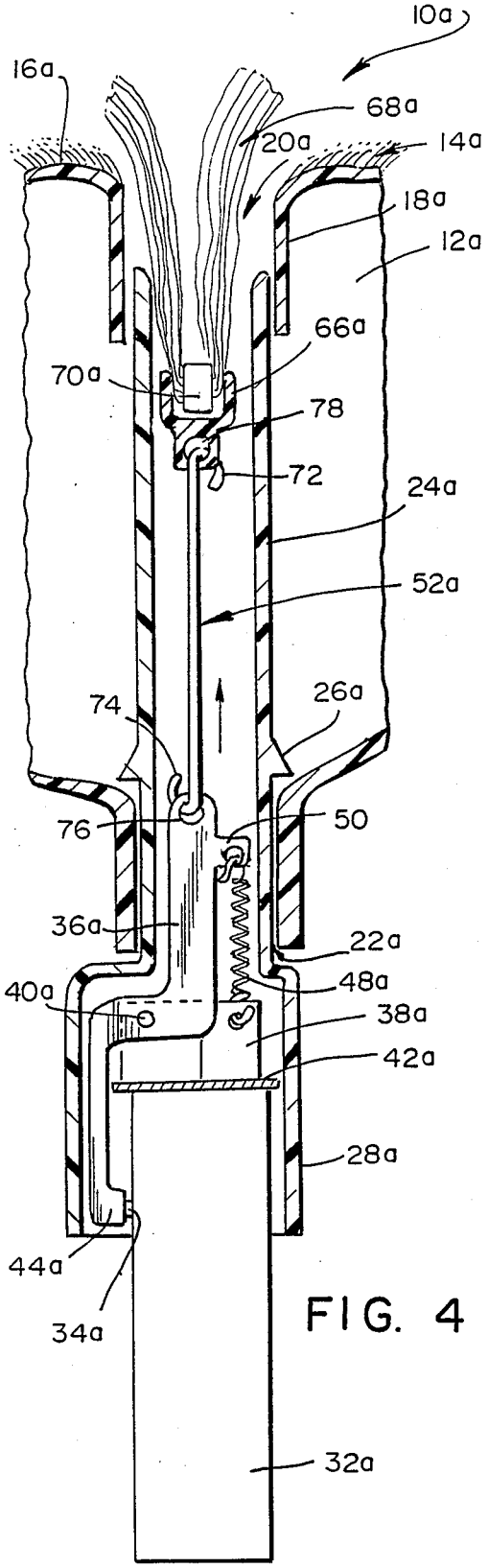
FIG. 4 is another embodiment of the comb and talk doll showing a plurality of hair strands secured to a wire link which operates a pivotal arm for actuating a sound mechanism.

In an alternate embodiment of the invention as shown in FIG. 4, like reference numerals being used for representing corresponding parts with the addition of the suffix "a".

An actuator arm **36*a* is connected directly to a hair cup 66*a* by a wire link 52*a*. The link 52*a* is provided with a pair of connector hooks 72, 74 at its opposite ends. The hook 74 is engageable within an aperture 76 and the hook 72 is connectable to the hair cup 66*a* through an aperture 78. The previously described hook connections provide for universal rotational movement at the respective ends of the wire link 52*a* for transmitting a vertical force to linearly displace the wire link 52a as a hair cluster 68a is combed or brushed in various directions radiating from a central aperture 20a**.

The device as shown in FIG. 4 is assembled by attaching the actuator arm 36a to a bracket 38a affixed to a frame 42a. A rivet 40a provides a pivot point for the actuator arm 36a. A spring 48a restores the actuator arm 36a to its initial position when the hair cluster 68a is released. The hair cluster 68a is attached to the hair cup 66a and can be cemented therein. The hook 74 is secured within the aperture 76 and a neck tube 24a and a housing 28a are secured together with the frame 42a accommodated within the housing 28a. A sound device 32a is next secured to the frame 42a and the neck tube 24a is inserted through a neck opening 22a. The hair cup 68a is then secured by the hook 72 of the wire link 52a.

The operation of the modified version as shown in FIG. 4 is similar to that described with regard to FIGS. 1–3.

A further variant of the invention is shown in FIG. 5 wherein like reference numerals have been used for representing corresponding parts with the addition of the suffix "b". The modification shown in FIG. 5 is intended for use with an alternate sound mechanism 32b which does not include pushbutton operation; for example, Ozen Model DPI5SSC includes a pair of lead wires for connection to a switch. Therefore, the pivotal actuator arm is not required. The modified device in this embodiment includes a tubular passageway 18b defining a central aperture 20b and a neck tube 24b. The neck tube 24b is secured within a neck opening 22b by a set of headlocks 26b. A hair shaft 52b is mounted within the neck tube 24b and includes a coil spring 80. The coil spring 80 is secured by a set of transverse ribs 82, 84. The transverse ribs 82, 84 permit linear movement of the hair shaft 52b in an axial direction. An upper end of the hair shaft 52b is snap-fit to a hair cup 62b. It should also be understood that the hair cup 62b can be pin connected to the hair shaft 52b or can be integrally formed therewith.

A hair cluster 68b, secured by a band 70b, is attached within the hair cup 62b as previously described in connection with the other embodiments.

A lower end of the hair shaft 52b includes a switch having an electrically conductive contact ring 86 which is secured to the shaft 52a by a cap 88. The cap 88 also clampingly secures one end of a lead wire 90 to the contact ring 86. An opposite end of lead wire 90 is connected to a negative terminal 92 of a battery within the sound mechanism 32b. It should be noted that the lead wire 90 is of sufficient length to maintain electrical conductivity with the contact ring 86 as the shaft 52b is linearly displaced during operation of the device.

A contact disk 94 is secured within the neck tube 24b and is spaced from the contact ring 86 as shown in FIG. 5. A lead wire 96 is connected at one end to the contact disk 94 and at its opposite end is connected to a positive terminal 98 of a battery within the sound mechanism 32b.

When the combable hair cluster 68b is engaged by a comb or brush, the frictional force displaces the hair shaft 52b upwardly as illustrated by the solid line arrow to compress the coil spring 80. The displacement of the shaft 52b will bring the contact ring 86 into engagement with the disk 94 to thus complete an electrical circuit whereby the sound mechanism 32b is energized. When the hair cluster 68b is released the coil spring 80 displaces the shaft 52b to open the circuit and deenergize the sound mechanism 32b.

It should thus be seen that there is provided a comb and talk doll which achieves the various objects of this invention and which is well adapted to meet conditions of practible use.

Since various possible embodiments might be made to the present invention or modifications might be made to the exemplary embodiments set forth, it is to be understood that all materials shown and described in the accompanying drawings are to be described as illustrative and not in a limiting sense

Having thus described the invention, there is claimed as new and desired to be secured by Letters Patent:

1. A comb and talk doll comprising a doll head including a plurality of extensible hair strands, hair securement means within the doll head for attaching the hair strands to the doll head, said hair securement means being yieldably displaceable in response to the application of a tensile force upon the hair strands, sound generating means within the doll, linkage means engageable by the hair securement means for displacement, said linkage means further being in communication with the sound generating means for actuating the sound generating means upon the application of a tensile force to the hair strands.

2. A comb and talk doll as claimed in claim 1 wherein the linkage means includes a pivotal actuator arm.

3. A comb and talk doll as claimed in claim 2 wherein the linkage means includes a hair shaft adapted for linear displacement.

4. A comb and talk doll as claimed in claim 3 wherein the hair shaft is comprised of a link member, one end of said link member being secured to the hair securement means and another end of said link member being attached to the actuator arm.

5. A comb and talk doll as claimed in claim 3 wherein the hair shaft includes electrical switch means for actuating the sound generating means.

6. A comb and talk doll as claimed in claim 3 wherein the actuator arm includes a cam surface, said hair shaft being adapted to engage the cam surface during lineal displacement of the hair shaft whereby the actuator arm is rotationally displaced.

7. A comb and talk doll as claimed in claim 3 wherein said shaft is adapted to rotationally displace the actuator arm from an initial position for actuating the sound generating means.

8. A comb and talk doll as claimed in claim 7 wherein the actuator arm is housed within a neck tube, said neck tube being securable within the head.

9. A comb and talk doll as claimed in claim 7 wherein the sound generating means is actuated by a pushbutton switch, the actuator arm being registrable with the pushbutton switch.

10. A comb and talk doll as claimed in claim 7 further including biasing means for restoring the actuator arm to the initial position when the tensile force upon the hair strands is released.

11. A comb and talk doll as claimed in claim 8 wherein the neck tube further includes a housing for accommodating the sound generating means.

12. A comb and talk doll as claimed in claim 11 wherein the sound generating means includes a battery powered sound mechanism for generating voice messages.

13. A comb and talk doll as claimed in claim 8 wherein the neck tube includes headlock means for securing the neck tube within the head.

14. A comb and talk doll as claimed in claim 11 wherein the hair securement means is adapted for snap-fit engagement with the linkage means.

15. A comb and talk doll comprising a doll head including a plurality of hair strands, hair securement means mounted within the doll head for attaching the hair strands to the doll head, said securement means being displaceable in response to the application of a tensile force upon the hair strands, said securement means further engaging a shaft, said shaft being adapted for linear displacement, sound generating means within the doll, a pivotal actuator arm engageable by the shaft, said shaft being adapted to displace the actuator arm for actuating the sound generating means upon the application of a tensile force to the hair strands.

16. A comb and talk doll as claimed in claim 15 further including stop means for limiting linear displacement of the shaft.

17. A noise generating figure toy comprising a body member, said body member including a plurality of hair strands, hair securement means mounted within the body member for attaching the hair strands to the body member, said hair securement means further being yieldably displaceable in response to the application of a tensile force upon the hair strands, sound generating means within the body member, linkage means interconnecting the hair securement means to the sound generating means, said linkage means being adapted to actuate the sound generating means in response to displacement of the hair securement means.

* * * * *